US009707624B2

(12) United States Patent
Lee et al.

(10) Patent No.: US 9,707,624 B2
(45) Date of Patent: Jul. 18, 2017

(54) METHOD OF SYNTHESIZING SILVER NANOPARTICLES

(71) Applicant: Korea Basic Science Institute, Daejeon (KR)

(72) Inventors: Gaehang Lee, Daejeon (KR); Yeon Suk Choi, Daejeon (KR)

(73) Assignee: KOREA BASIC SCIENCE INSTITUTE, Daejeon (KR)

( * ) Notice: Subject to any disclaimer, the term of this patent is extended or adjusted under 35 U.S.C. 154(b) by 372 days.

(21) Appl. No.: 14/563,494

(22) Filed: Dec. 8, 2014

(65) Prior Publication Data

US 2016/0121401 A1 May 5, 2016

(30) Foreign Application Priority Data

Nov. 3, 2014 (KR) ..... 10-2014-0150916

(51) Int. Cl.

| | |
|---|---|
| ***B22F 9/24*** | (2006.01) |
| ***C22B 3/00*** | (2006.01) |
| ***B22F 1/00*** | (2006.01) |
| ***C22C 5/06*** | (2006.01) |

(52) U.S. Cl.

CPC ..... *B22F 9/24* (2013.01); *B22F 1/0018* (2013.01); *C22B 11/04* (2013.01); *C22C 5/06* (2013.01); *B22F 2301/255* (2013.01)

(58) Field of Classification Search

None

See application file for complete search history.

(56) References Cited

U.S. PATENT DOCUMENTS

| | | | | |
|---|---|---|---|---|
| 7,744,834 | B2 * | 6/2010 | Lee | B22F 1/0018 106/31.92 |
| 7,931,730 | B2 * | 4/2011 | Lee | B22F 9/24 75/371 |
| 8,147,908 | B2 * | 4/2012 | Mokhtari | B22F 1/0018 106/31.01 |
| 2009/0053649 | A1 * | 2/2009 | Nakashima | C08F 220/18 430/285.1 |
| 2015/0132595 | A1 * | 5/2015 | Lee | B22F 9/24 428/544 |

FOREIGN PATENT DOCUMENTS

| | | |
|---|---|---|
| JP | 4635262 B2 | 2/2011 |
| KR | 10-0790457 | 12/2007 |
| KR | 10-2009-0012605 | 2/2009 |

* cited by examiner

*Primary Examiner* — George Wyszomierski

(74) *Attorney, Agent, or Firm* — Hauptman Ham, LLP

(57) ABSTRACT

Provided is a method of synthesizing silver nanoparticles including: a) a nucleation step of reacting a composition containing a silver precursor, a heterogeneous metal precursor, and an amine-based compound at 30 to 120° C. to form a nucleus; and b) a growth step of reacting the composition containing the nucleus formed therein at 155 to 350° C. to grow the nucleus. According to the present invention, significantly uniform and fine silver nanoparticles may be synthesized with high reproducibility on a large scale.

10 Claims, 4 Drawing Sheets

| | Nucleation Step (°C) | Growth Step (°C) | TEM image | $D_A$ (nm) | $\lvert D_A-D \rvert$ (nm) | Yield (%) |
|---|---|---|---|---|---|---|
| Example 1 | 80 | 155 |  | 8.3 | ≤0.4 | ≥90 |
| Example 2 | 80 | 165 |  | 8.4 | ≤0.5 | ≥90 |
| Example 3 | 80 | 175 |  | 8.3 | ≤0.6 | ≥90 |
| Example 4 | 80 | 185 |  | 8.5 | ≤0.7 | ≥90 |
| Example 5 | 80 | 200 |  | 8.6 | ≤0.7 | ≥90 |

| | Nucleation Step (℃) | Growth Step (℃) | TEM image | $D_A$ (nm) | $\lvert D_A - D \rvert$ (nm) | Yield (%) |
|---|---|---|---|---|---|---|
| Example 1 | 80 | 155 |  | 8.3 | ≤0.4 | ≥90 |
| Example 2 | 80 | 165 |  | 8.4 | ≤0.5 | ≥90 |
| Example 3 | 80 | 175 |  | 8.3 | ≤0.6 | ≥90 |
| Example 4 | 80 | 185 |  | 8.5 | ≤0.7 | ≥90 |
| Example 5 | 80 | 200 |  | 8.6 | ≤0.7 | ≥90 |

| | Nucleation Step (℃) | Growth Step (℃) | TEM image | $D_A$ (nm) | $\lvert D_A - D \rvert$ (nm) | Yield (%) |
|---|---|---|---|---|---|---|
| Comparative Example 1 | 80 | 130 |  | 5.1 | >2 | <60 |
| Comparative Example 2 | 80 | 152 |  | 7.8 | >1 | <90 |

METHOD OF SYNTHESIZING SILVER NANOPARTICLES

CROSS-REFERENCE TO RELATED APPLICATIONS

This application claims priority under 35 U.S.C. §119 to Korean Patent Application No. 10-2014-0150916, filed on Nov. 3, 2014, in the Korean Intellectual Property Office, the disclosure of which is incorporated herein by reference in its entirety.

TECHNICAL FIELD

The following disclosure relates to a method of synthesizing silver nanoparticles having a uniform size.

BACKGROUND

Unlike silver generally used in real life, chemical, physical, and optical properties of nano-sized silver particles are significantly different from each other according to a shape and a size, and unexpected properties may be exhibited. Therefore, silver nanoparticles have proven to be highly efficient in various fields such as a sensor, a catalyst, an electronic circuit, photonics, and the like, by using properties of the silver nanoparticles.

A most important factor for using and commercializing the silver nanoparticles as described above is synthesis of particles having a uniform shape and size. Methods for synthesizing silver nanoparticles in a liquid phase have been widely known. The methods may be roughly divided into a method of synthesizing silver nanoparticles in a hydrophilic solvent and a method of synthesizing silver nanoparticles in a hydrophobic solvent.

More specifically, in the method of synthesizing silver nanoparticles in a hydrophilic solvent, water or alcohol is mainly used as the solvent, and an oxidized silver precursor is reduced using $NaXH_4$ (X=B or Al), hydrazine, or the like, which is a strong reducing agent. In the method of synthesizing silver nanoparticles in a hydrophilic solvent, there are various limitations in view of mass-production, non-uniform shape and sizes, and the like.

In order to solve the problems as described above, many researchers developed a method of synthesizing uniform silver nanoparticles in a hydrophobic solvent. A method of mixing a paraffin solvent, a silver precursor, and an amine molecule serving as a surfactant and a reducing agent, or a molecule containing two or more hydroxyl groups corresponding to a separate reducing agent with each other and inducing a chemical reaction for nanoparticles has been mainly used. Uniform silver nanoparticles may be synthesized through the chemical reaction in this hydrophobic solvent, but in a process of dissolving the silver precursor, which is hydrophilic, nanoparticles are partially already formed, such that non-uniform nanoparticles may be formed.

For example, a method of synthesizing silver nanoparticles having a size of 1 to 40 nm by using a silver precursor, a heterogeneous metal precursor, and alkyl amine has been disclosed in Korean Patent Laid-Open Publication No. 10-2009-0012605. However, in this method, dissociation and reduction reactions are carried out at a single temperature of 150° C. or less, such that size uniformity of the silver nanoparticles may be slightly deteriorated.

That is, the methods known in the art have problems in view of uniformity and reproducibility. Therefore, in order to synthesize significantly uniform silver nanoparticles on a large scale, a method capable of synthesizing silver nanoparticles through a simple synthesis process, having reproducibility, and satisfying a low cost synthesis should be developed.

RELATED ART DOCUMENT

Patent Document (Patent Document 1) Korean Patent Laid-Open Publication No. 10-2009-0012605

(Patent Document 2) Korean Patent Publication No. 10-0790457

SUMMARY

An embodiment of the present invention is directed to providing a method of synthesizing silver nanoparticles having uniform size distribution on a large scale with high reproducibility.

In one general aspect, a method of synthesizing silver nanoparticles includes:

a) a nucleation step of reacting a composition containing a silver precursor, a heterogeneous metal precursor, and an amine-based compound at 30 to 120° C. to form a nucleus; and b) a growth step of reacting the composition containing the nucleus formed therein at 155 to 350° C. to grow the nucleus.

In step a), the reacting of the composition may be performed for 30 to 90 minutes.

In step b), the reacting of the composition containing the nucleus formed therein may be performed for 1 to 4 hours.

In step b), a reaction temperature may be raised by heating at a heating rate of 5° C./min or more from step a).

The composition may contain 5 to 20 wt % of the silver precursor, 0.001 to 2 wt % of the heterogeneous metal precursor, and 78 to 95 wt % of the amine-based compound based on the entire composition.

The silver precursor may be $AgNO_3$, $AgNO_2$, $Ag(CH_3CO_2)$, AgCl, $Ag_2SO_4$, $AgClO_4$, $Ag_2O$, or a mixture thereof.

The heterogeneous metal precursor may be a zinc (Zn) precursor, an iron (Fe) precursor, a copper (Cu) precursor, a tin (Sn) precursor, or a mixture thereof.

The zinc (Zn) precursor may be $Zn(acac)_2$, $Zn(CH_3CO_2)_2$, $ZnCl_2$, $ZnBr_2$, $ZnI_2$, $ZnSO_4$, $Zn(NO_3)_2$, or a mixture thereof.

The amine-based compound may be oleylamine, propylamine, butylamine, hexylamine, octylamine, decylamine, dodecylamine, hexadecylamine, octadecylamine, or a mixture thereof.

The silver nanoparticles may have an average diameter ($D_A$) of 5 to 20 nm.

Hereinafter, the present invention will be described in detail.

The present invention is characterized in that the reaction for synthesizing silver nanoparticles having a uniform size is performed through two steps, that is, the nucleation step and the growth step of the formed nucleus.

The silver nanoparticles having a uniform size may be synthesized by uniformly growing the nucleus after primarily forming the nucleus. In order to synthesize the uniform silver nanoparticles as described above, usage of the heterogeneous metal precursor and a reaction temperature at each of the steps are significantly important.

That is, the silver nanoparticles may be synthesized so as to have a uniform size by using a small amount of heterogeneous precursor and controlling the reaction temperature to thereby suppress growth at the time of nucleation and suppress nucleation at the time of growth of the nucleus.

To this end, it is preferable that at the time of raising the reaction temperature to the growth step after nucleation, unnecessary nucleation is suppressed by increasing the heating rate to maximally decrease a temperature change time.

The nucleation step will be described in detail.

The nucleation step is a step of forming the nucleus by reacting the composition containing the silver precursor, the heterogeneous metal precursor, and the amine-based compound. In this step, the reaction temperature and time, concentrations of the heterogeneous metal precursor and the silver precursor, and the like, are important.

The heterogeneous metal precursor is used at a content of 0.001 to 2 wt % in the entire composition in order to allow the uniform silver nanoparticles to be synthesized, and in the case in which the heterogeneous metal precursor is reacted at 50 to 120° C., more preferably 70 to 100° C., it is possible to form the nucleus while suppressing growth. The growth is suppressed as described above, thereby making it possible to suppress size distribution from being broad due to growing the formed nucleus ahead of time.

As the heterogeneous metal precursor, for example, any one selected from the zinc (Zn) precursor, the iron (Fe) precursor, the copper (Cu) precursor, the tin (Sn) precursor, or the mixture thereof may be used. More specifically, as zinc (Zn) precursor, any one selected from $Zn(acac)_2$, $Zn(CH_3CO_2)_2$, $ZnCl_2$, $ZnBr_2$, $ZnI_2$, $ZnSO_4$, $Zn(NO_3)_2$, or the mixture thereof may be used, but the present invention is not limited thereto.

In addition, in the nucleation step, an amount of the formed nucleus may be adjusted depending on the reaction time. For example, the reaction time may be preferably 30 to 90 minutes, more preferably 40 to 80 minutes, but is not particularly limited thereto. That is, it is preferable to control the reaction time in consideration of the concentration of the silver precursor, sizes of silver nanoparticles to be synthesized, and the like.

However, when the reaction time is excessively increased, undesired growth of the nucleus may occur, or silver ions are excessively consumed to form the nucleus, such that the nucleus may not sufficiently grow in a subsequent step.

It is preferable that the silver precursor according to the present invention is used at a content of 5 to 20 wt % in the entire composition, and in view of nucleation, it is effective to use the silver precursor in the above-mentioned range. In the case in which the concentration of the silver precursor is excessively low, the nucleus may not be suitably formed, and in the case of using an excessively large amount of silver precursor, dissociation may not be smoothly performed, which is not suitable.

Any silver precursor may be used without a particular limitation as long as it provides silver ions. For example, any one selected from $AgNO_3$, $AgNO_2$, $Ag(CH_3CO_2)$, AgCl, $Ag_2SO_4$, $AgClO_4$, $Ag_2O$, or a mixture thereof may be used.

Next, the amine-based compound according to the present invention, which serves as a solvent, a surfactant, a reducing agent, and the like, is used at a content of preferably 78 to 95 wt % in the entire composition. When the amine-based compound is used in the above-mentioned range, the silver precursor may be easily dispersed and dissociated, and silver particles may be effectively reduced.

As the amine-based compound, any one selected from oleylamine, propylamine, butylamine, hexylamine, octylamine, decylamine, dodecylamine, hexadecylamine, octadecylamine, or a mixture thereof may be used, but the present invention is not limited thereto.

In the nucleation step, the stirring may be simultaneously performed so that dispersion and dissociation are more evenly generated, and the stirring is performed at preferably 100 to 1000 rpm, more preferably 300 to 800 rpm. When the stirring is performed at the above-mentioned range, nucleation may not be inhibited.

The growth step will be described in detail.

This step is a step of synthesizing the silver nanoparticles having a uniform size and shape by uniformly growing the nucleus formed in the nucleation step. In this step, the reaction temperature, the heterogeneous metal precursor, and the like, are important.

In this step, the heterogeneous metal precursor may suppress formation of a new nucleus and induce uniform growth of the formed nucleus, unlike the nucleation step. To this end, it is preferable that the reaction is performed at a temperature of 155° C. or more. In the case of a growth reaction is performed at a temperature lower than 155° C., a new nucleus is formed together with growth of the nucleus, such that the particles may become significantly non-uniform. The reaction temperature may be preferably 155 to 350° C., and more preferably 155 to 250° C. Since the amine-based compound is volatilized at 350° C. or more and accordingly, growth of the particles does not proceed, the reaction temperature may be adjusted depending on the kind of used compound.

The heterogeneous metal precursor induces the silver nanoparticles having a significantly uniform size to be synthesized at a temperature of 155° C. or more as described above, such that spherical silver nanoparticles having an average diameter ($D_A$) of 5 to 20 nm may be synthesized, but the present invention is not limited thereto.

In this case, the synthesized silver nanoparticles may have a diameter satisfying the following Equation 1, such that the silver nanoparticles according to the present invention may have significantly uniform size distribution.

$$D_A-0.7\text{ nm}\leq D\leq D_A+0.7\text{ nm} \quad \text{[Equation 1]}$$

Here, D is a diameter of each of the silver nanoparticles, and $D_A$ is the average diameter of the silver nanoparticles.

Therefore, during the temperature change time from the nucleation step to the growth step, it is important to rapidly raise the reaction temperature so that nucleation and growth do not simultaneously occur. The reaction temperature is raised at a heating rate of preferably 5° C./min or more, more preferably, 8° C./min or more, and an upper limit of the heating rate is not separately restricted. However, actually, when the upper limit of the heating rate is 50° C./min or less, it may be easy to adjust the reaction temperature, but the present invention is not limited thereto.

In the case in which the heating rate is less than 5° C./min or less, as the temperature is slowly raised, temperature distribution becomes broad, and nucleation and growth may simultaneously occur, such that the size of the silver nanoparticles becomes non-uniform as shown in FIG. 3.

Further, while raising the temperature in a heating process, the entire temperature of the reaction solution is constantly raised by temporarily performing the stirring at a significantly rapid rate, such that growth may further uniformly occur. For example, the stirring may be performed at 1000 to 2000 rpm, more preferably, 1200 to 1500 rpm.

In the growth step, a reaction time is not particularly limited, but it is preferable that the reaction time is, for example, 1 to 4 hours. The reaction time may be adjusted in consideration of sizes of silver nanoparticles to be synthesized, a concentration of the remaining silver ion, and the like.

In addition, the stirring may be simultaneously performed in a range in which growth of the nucleus is not inhibited. For example, the stirring is performed at preferably, 50 to 500 rpm, more preferably 100 to 400 rpm. The stirring is performed in the above-mentioned range, which is effective for uniform growth of the silver nanoparticles.

The method of synthesizing silver nanoparticles according to the present invention may further include a purification step.

After the reaction solution is cooled to room temperature after the growth step, alcohol, an organic solvent, or a mixture thereof is added thereto and centrifuged, thereby making it possible to obtain precipitates. This centrifugation step may be performed one time or more, such that by-products and the excessive amount of amine-based compound may be removed.

DETAILED DESCRIPTION OF EMBODIMENTS

Hereinafter, a method of synthesizing silver nanoparticles according to the present invention will be described in more detail through the following Examples. However, the following Examples are only to specifically explain the present invention, but the present invention is not limited thereto and may be implemented in various forms.

In addition, unless defined otherwise in the specification, all the technical and scientific terms used in the specification have the same meanings as those that are generally understood by those who skilled in the art. The terms used in the specification are only to effectively describe a specific Example, but are not to limit the present invention.

Further, the accompanying drawings to be described below are provided by way of example so that the idea of the present invention can be sufficiently transferred to those skilled in the art to which the present invention pertains. Therefore, the present invention is not limited to the drawings to be provided below, but may be modified in many different forms. In addition, the drawings to be provided below may be exaggerated in order to clarify the scope of the present invention.

In addition, unless the context clearly indicates otherwise, it should be understood that a term in singular form used in the specification and the appended claims includes the term in plural form.

Physical properties of the silver nanoparticles prepared in the following Examples and Comparative Examples were measured as follows.

(Confirmation of Synthesis of Silver Nanoparticles)

Synthesis of silver nanoparticles was confirmed using an X-ray diffractometer (XRD, Rigaku D/MAX-RB diffractometer at 12 kW with a graphite-monochromatized Cu-Kα radiation at 40 kV and 120 mA).

(Measurement of Size and Shape)

Sizes and shapes of the silver nanoparticles were confirmed using a transmission electron microscope (TEM, Philips F20 Tecnai operated at 200 kV).

EXAMPLE 1

After a composition containing 1 g of $AgNO_3$, 10 mg of $Zn(acetylacetonate)_2$, and 10 mL of oleylamine was put in a 50 ml vial and heated to 80° C. while stirring at 500 rpm to dissociate the silver precursor, followed by reaction for 1 hour, thereby forming a nucleus. Then, a reaction temperature was raised to 155° C. at a heating rate of 9° C./min, and a reaction was performed for 3 hours while stirring at 300 rpm, thereby growing the nucleus. After the reaction was terminated, the reaction solution was cooled to room temperature.

10 mL of ethanol was added to the reaction solution of which the temperature became room temperature, and centrifugation was performed at 3,000 rpm for 10 minutes, thereby obtaining precipitates. In order to remove by-products and an excessive amount of oleylamine, 5 mL of toluene and 10 mL of ethanol were added to the precipitates and then centrifuged at 3,000 rpm for 10 minutes, thereby obtaining silver nanoparticles having an average diameter of 8.3 nm.

EXAMPLES 2 TO 5

Figure 1:
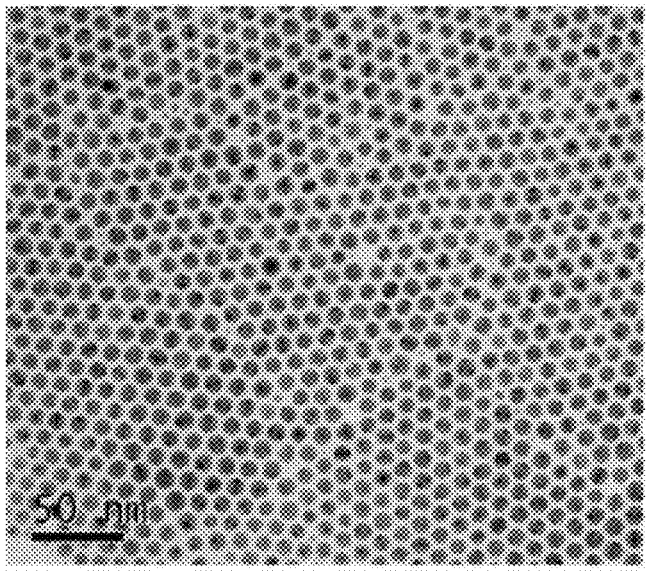
FIG. 1 is a transmission electron microscope photograph of silver nanoparticles synthesized according to Example 1 of the present invention.
Figure 2:
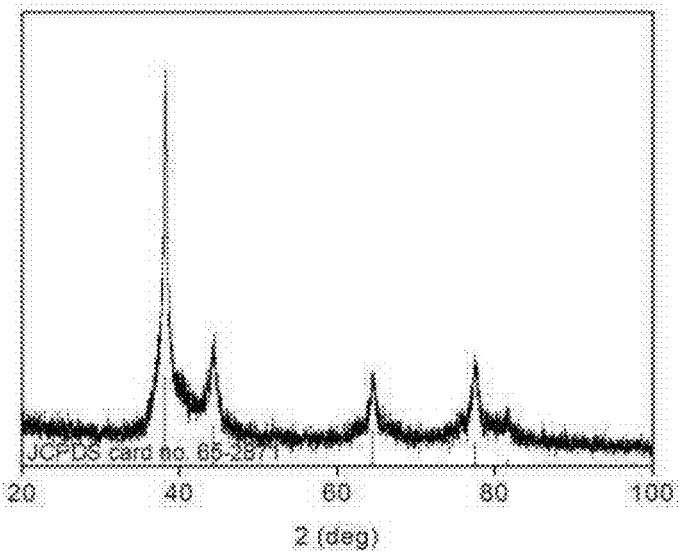
FIG. 2 is an x-ray diffraction (XRD) pattern of the silver nanoparticles synthesized according to Example 1 of the present invention.
Figure 3:
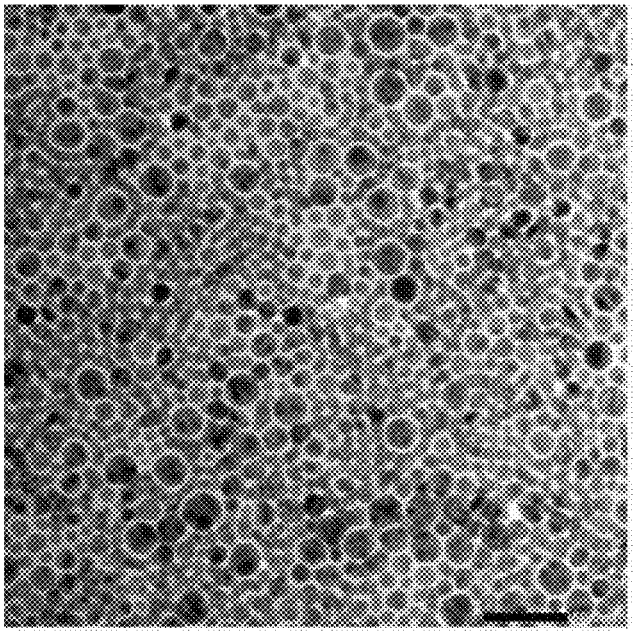
FIG. 3 is a transmission electron microscope photograph of silver nanoparticles synthesized at a heating rate of 3° C./min.
Figure 4:
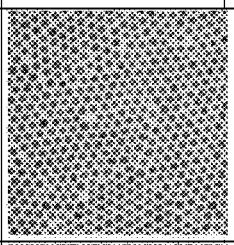
FIGS. 4(A) and 4(B) show growth conditions of silver nanoparticles according to some embodiments, as well as TEM photos and characterizations of the result silver nanoparticles.
Figure 4:
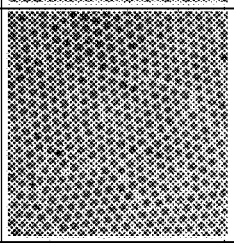
Figure 4:
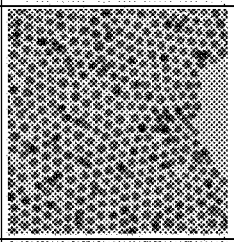
Figure 4:
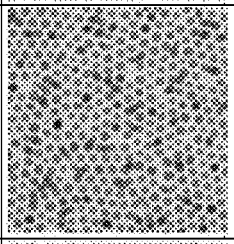
Figure 4:
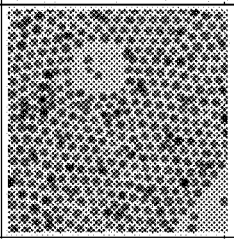
Figure 4:
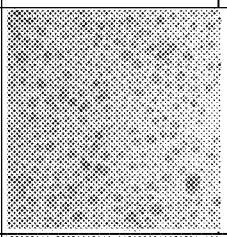
Figure 4:
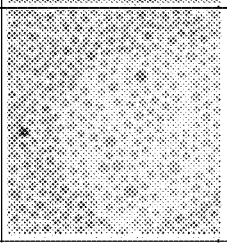

All of the processes were the same as those in Example 1 except that a temperature during a growth step was different as shown in FIG. 4(A).

COMPARATIVE EXAMPLES 1 AND 2

All of the processes were the same as those in Example 1 except that a temperature during agrowth step was different as shown in FIG. 4(B).

(In FIGS. 4(A) and 4(B), $D_A$ is an average diameter of the silver nanoparticles, and D is a diameter of each of the silver nanoparticles.)

As shown in FIGS. 4(A) and 4(B), in the cases of the silver nanoparticles of Examples 1 to 5 in which the growth occurred at a reaction temperature of 155 to 200° C., at the time of observing the silver nanoparticles using the TEM, silver nanoparticles having a significantly uniform size were observed. On the contrary, it may be appreciated that in the case of the silver nanoparticles of Comparative Examples 1 and 2 in which the growth occurred at a reaction temperature lower than 155° C., since nucleation simultaneously occurred at the time of growth, the sizes of the particles were not uniform but were significantly different.

Further, in Examples 1 to 5, the silver nanoparticles were synthesized with a high yield of 90% or more, and at the time of observing sizes of the silver nanoparticles, it may be confirmed that about 95% or more of the silver nanoparticles have a diameter within ±1.3 nm of the average diameter, but the silver nanoparticles of Comparative Examples 1 and 2 had larger size distribution.

When the same process as in the method of synthesizing silver nanoparticles according to the present invention was repeated 20 times, similar results were obtained at a rate of 950 or more. That is, the silver nanoparticles having a significantly uniform size and high yield were synthesized, such that high reproducibility was shown.

EXAMPLE 6

After a composition containing 200 g of $AgNO_3$, 2 g of Zn(acetylacetonate)$_2$, and 2 L of oleylamine was put in a 10 L reactor and heated to 80° C. while stirring at 500 rpm to dissociate the silver precursor, followed by reaction for 1 hour, thereby forming a nucleus. Then, a reaction temperature was raised to 155° C. at a heating rate of 9° C./min, and a reaction was performed for 3 hours while stirring at 300 rpm, thereby growing the nucleus. After the reaction was terminated, the reaction solution was cooled to room temperature.

2 L of ethanol was added to the reaction solution of which the temperature became room temperature, and centrifugation was performed at 3,000 rpm for 10 minutes, thereby obtaining precipitates. In order to remove by-products and an excessive amount of oleylamine, 1 L of toluene and 1 L of ethanol were added to the precipitates and then centrifuged at 3,000 rpm for 10 minutes, thereby obtaining silver nanoparticles having an average diameter of 8.2 nm. At this time, a yield was 90% or more.

In Example 6, since the same processes as in Example 1 were performed except for increasing the scale to 200 times the scale in Example 1 to synthesize the silver nanoparticles on a large scale, similar results to those in Example 1 could be obtained, and significantly uniform silver nanoparticles could be synthesized. That is, it was confirmed that the silver nanoparticles may be easily synthesized on a large scale.

In the method of synthesizing silver nanoparticles according to the present invention, the significantly uniform and fine silver nanoparticles may be synthesized by reacting the composition containing the silver precursor, the heterogeneous metal precursor, and the amine-based compound through multi-step processes.

In addition, the method of synthesizing silver nanoparticles according to the present invention may have high reproducibility.

What is claimed is:

1. A method of synthesizing silver nanoparticles, the method comprising:

a) a nucleation step of reacting a composition containing a silver precursor, a heterogeneous metal precursor, and an amine-based compound at 30 to 120° C. to form a nucleus; and b) a growth step of reacting the composition containing the nucleus formed therein at 155 to 350° C. to grow the nucleus.

2. The method of claim 1, wherein in step a), the reaction of the composition is performed for 30 to 90 minutes.

3. The method of claim 1, wherein in step b), the reacting of the composition containing the nucleus formed therein is performed for 1 to 4 hours.

4. The method of claim 1, wherein the reaction temperature of step b) is achieved by increasing temperature from the reaction temperature of step a) at a rate of 5° C./min or more.

5. The method of claim 1, wherein the composition contains 5 to 20 wt % of the silver precursor, 0.001 to 2 wt % of the heterogeneous metal precursor, and 78 to 95 wt % of the amine-based compound based on the entire composition.

6. The method of claim 1, wherein the silver precursor is $AgNO_3$, $AgNO_2$, $Ag(CH_3CO_2)$, AgCl, $Ag_2SO_4$, $AgClO_4$, $Ag_2O$, or a mixture thereof.

7. The method of claim 1, wherein the heterogeneous metal precursor is a zinc (Zn) precursor, an iron (Fe) precursor, a copper (Cu) precursor, a tin (Sn) precursor, or a mixture thereof.

8. The method of claim 7, wherein the heterogeneous metal precursor is Zn(acac)$_2$, $Zn(CH_3CO_2)_2$, $ZnCl_2$, $ZnBr_2$, $ZnI_2$, $ZnSO_4$, $Zn(NO_3)_2$, or a mixture thereof.

9. The method of claim 1, wherein the amine-based compound is oleylamine, propylamine, butylamine, hexylamine, octylamine, decylamine, dodecylamine, hexadecylamine, octadecylamine, or a mixture thereof.

10. The method of claim 1, wherein the silver nanoparticles have an average diameter (DA) of 5 to 20 nm.

* * * * *